United States Patent [19]

Anderson et al.

[11] Patent Number: 4,559,961

[45] Date of Patent: Dec. 24, 1985

[54] SANITIZER SYSTEM FOR BEVERAGE CAN FILLER MACHINE

[76] Inventors: Frank E. Anderson; Robert A. Martin, both of 501 S. Phoenix, P.O. Box 145, Fort Smith, Ark. 72902

[21] Appl. No.: 600,766

[22] Filed: Apr. 16, 1984

[51] Int. Cl.[4] ..... B08B 9/00; B65B 3/04

[52] U.S. Cl. ..... 134/166 R; 141/91; 141/98; 141/165

[58] Field of Search ..... 141/85-92, 141/1-12, 98, 392, 37-70, 129-191, 367, 368, 312, 250-284; 134/166 R, 166 C, 169 R, 169 C, 23; 137/237, 238; 222/148-151

[56] References Cited

U.S. PATENT DOCUMENTS 4,212,414 7/1980 Beyens ..... 141/91

4,489,769 12/1984 Catelli ..... 141/91

*Primary Examiner*—Houston S. Bell, Jr.

*Attorney, Agent, or Firm*—Robert R. Keegan

[57] ABSTRACT

A sanitizing method and a sanitizer system to be attached to a conventional circular beverage can filling machine, the system including a plurality of collector manifolds, each manifold being adapted to collect sanitizing liquid from a plurality of adjacent can filler valve centering bells, there being sufficient number of manifolds with plural bell sealing rings to accommodate every filler valve of a particular machine; the manifolds are connectable by flexible hoses to a rotating collector which is preferably permanently installed at the top of the can filler machine; the entry ports of the collector rotate with the rotating conveyor table of the machine and the exit port of the collector is from a stationary portion thereof. There is a provision for passage of carbon dioxide gas through the center of the collector to maintain carbonation in the beverage in the filler bowl. Clamps are provided for the manifolds to hold their sealing rings firmly up against the taper of the filler valve centering bells. Hoses are connectable to the manifolds by quick connect fittings; the manifolds are completely removable and there is no modification required to the filler valves or other parts of the machine which might interfere with the normal filling operation.

13 Claims, 6 Drawing Figures

SANITIZER SYSTEM FOR BEVERAGE CAN FILLER MACHINE

The present invention relates to apparatus to periodically hot sanitize carbonated beverage can filler machines to give maximum assurance that any bacterial, mold, or yeast contamination has been eliminated. More specifically, the present invention relates to accessory equipment which can be added to a conventional can filler machine to provide the capability of sanitizing all product contacting components at a sterilizing temperature of at least 185° F., for a time period necessary to insure sterility of all such components and freedom from contamination by any live micro-organisms.

Some filler machines of recent design have provided built-in capability for high-temperature sanitizing of components in contact with the product. However, many can filler machines do not have this built-in hot sanitizing capability. Apparatus according to the present invention permits the addition of hot sanitizing capability to an existing can filler machine in a manner which is inexpensive, convenient, simple and highly effective.

The need for more effective sanitizing procedures in beverage can filler machines comes about in part because of the introduction of beverages in this country which do not have the high acid content that was common in popular beverages of previous years. The recent non-acidic beverages provide a much more favorable environment for the growth of micro-organisms and thus require more elaborate precautions to prevent contamination of the product.

The most acceptable procedure for insuring sterility of the equipment components in contact with the product is to expose such components to an elevated temperature of at least 185° F., for a period of several minutes to an hour. This can be accomplished by flooding the components with hot water or a hot cleaning and sterilizing solution or a combination thereof. The method for sanitizing beverage containers in this manner and apparatus therefor is described in U.S. Pat. No. 4,414,036 to Frank E. Anderson and Robert A. Martin granted Nov. 8, 1983.

Other previous designs of filler machines are customarily provided with a cleaning and sanitizing system of some kind but they are not capable of providing a true hot sterilizing process. Typicaly such machines have a water heater and liquid flow controls and timer which permit the filling valves to be flushed with hot water or hot cleaning liquid. The hot liquid in the cleaning process in the old machines is simply dumped on the floor where it is drained away to the waste water system. Since the water is wasted the system of the previous appartus cannot be operated long enough to insure sterilization of the critical components of the bottle filler machine. Furthermore,the critical components are not completely flooded in the cleaning process.

The following patents and patents cited in U.S. Pat. No. 4,414,036 relate to apparatus for sanitizing container filling apparatus but they do not solve the problem to which the present invention is directed nor have its advantages of efficiency and convenience:

U.S. Pat. No. 3,513,024 (1970) to Culliton;

U.S. Pat. No. 3,945,411 (1876) to Skoli et at.

The improved apparatus according to the present invention provides accessory equipment which is in part permanently and in part temporarily installed on the bottle filler machine and provides the capability of completely flooding all critical components of the apparatus with hot sanitizing liquid for as long as necessary, normally a few minutes to an hour. The hot water or sanitizing liquid is re-circulated within the apparatus (except for an insignificant portion flushed through the snift valves). Reduction of the amount of water used is, of course, an advantge, but the saving in energy required to heat the water is perhaps even more important. Such apparatus has not previously been available for can filler machines.

In apparatus according to the present invention hot water or hot sanitizing solution is directed from the carbo-cooler through the filler bowl and the filler valves where it contacts all surfaces which the beverage comes in contact with. The flow rate for the liqud may be from ten to 40 gallons per minute and the liquid is collected from the filler valves and returned to the CIP tank in a continuous re-circulating process. This procedure takes place while the filler machine table and valves are rotating at the normal rate or at a slightly reduced rate. The snift valve operating mechanism is active during the sanitizing operation and each snift valve is flushed with hot water or sanitizing solution once during each rotation of the machine. Typical can filler machines to which the present apparatus may be attached are the Crown Uni-Blend 72-valve filler, or the Crown Uni-Blend 100-valve filler. With slight modifications apparatus according to the present invention may be added to most similar beverage can filler machines which in general are improvements and modifications to apparatus as shown in W. J. Sommers U.S. Pat. No. 2,847,043 issued Aug. 12, 1958.

Typically the manifolds for collecting solution from the filler valves will be provided with collector tubes to collect from five filler valves. Thus, with a 100-valve filler machine, 20 manifolds will be required. A rotating collector is permanently installed at the top of the machine and stainless steel tubes with Teflon inner lining connect each of the 20 manifolds to an inlet port in the rotating collector.

It is preferred that the filler bowl be completely flooded and accordingly the liquid level controls for the filler bowl are disabled, and a further flexible stainless steel tube with Teflon inner lining is connected from the overflow of the filler bowl to the rotating collector. In the usual arrangement each manifold is provided with clamps which are used to hold the five manifold sealing rings in an upward position firmly against the corresponding centering bell tapers.

The manifolds and the clamps are installed for the sanitizing procedures and removed when the procedure is completed. The other equipment, including the rotating collector and the tubes, remain on the machine during normal filling operations. The tubes are connected to the manifold by a quick connect fitting and dummy fittings are installed on the rotating conveyor to retain the ends of the tubes during normal filling operations so that they cannot interfere with such operations.

Can filler machines are normally provided with sources of hot and cool water, means for providing washing or sanitizing solutions, pumps for fluid circulation, and timing controls which may be employed in the hot sanitizing procedure of the present invention. In the event that a can filler lacks any of these features it may be readily supplied from commercially available products. The complete operation of apparatus according to the invention will be described following the detailed description of the apparatus.

In addition to providing the above described advantages and features, it is an object of the present invention to provide apparatus for hot sanitizing conventional can filler machines, including manifolds with bell-engaging sealing means and a rotating collector through which hot sanitizing solution may be circulated to flood all portions of the apparatus exposed to the product during normal filling operations.

It is another object of the invention to provide such hot sanitizing apparatus consisting of relatively simple and inexpensive attachment apparatus which in part may be permanently installed without interfering with the normal filling operation or otherwise readily removed to return the apparatus to its normal can filler configuration.

Other objects and advantages will be apparent from consideration of the following description in conjunction with the appended drawings in which.

Figure 1:
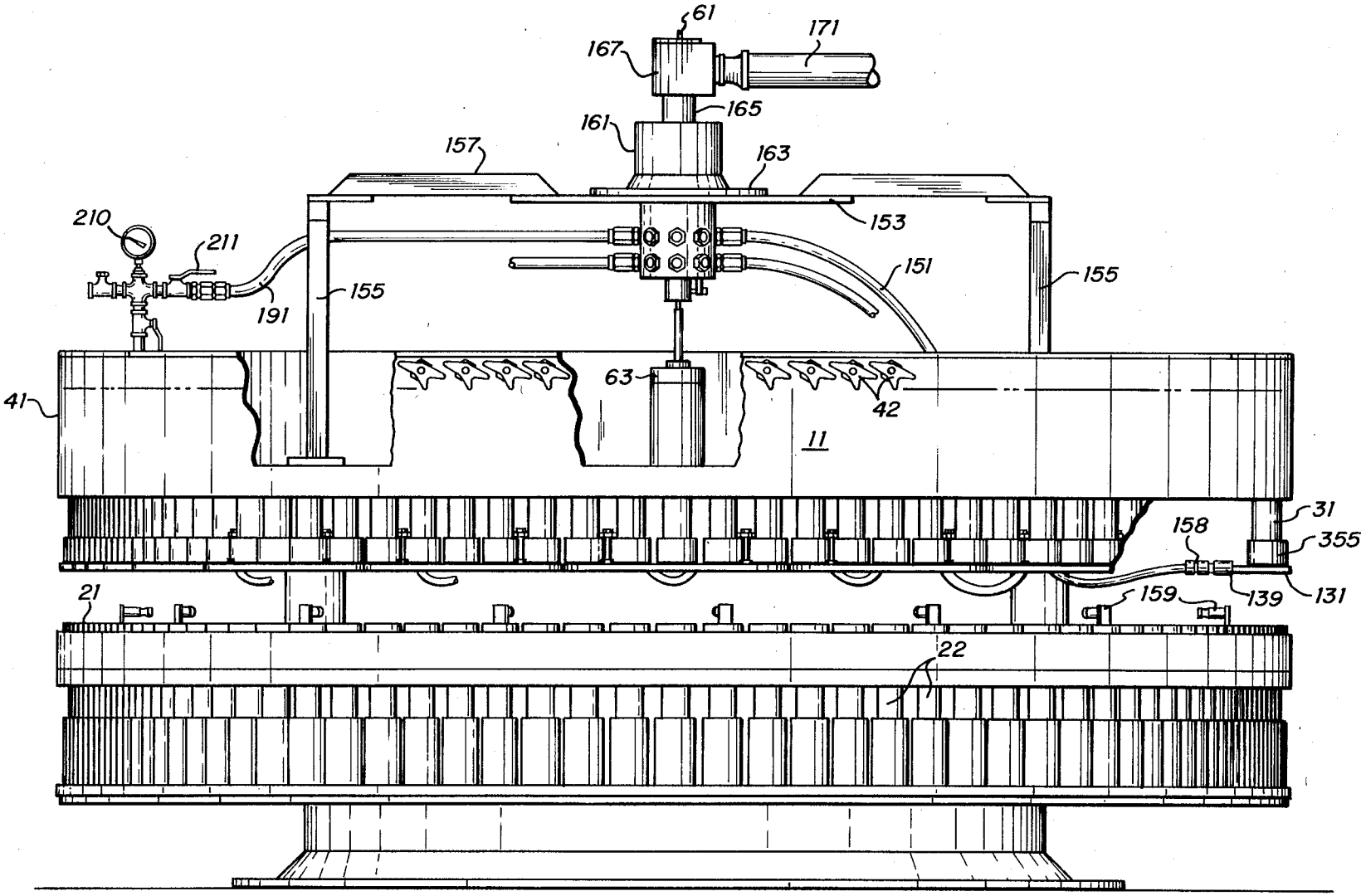
FIG. 1 is a side elevational partially fragmentary view of a portion of a conventional can filler machine with apparatus according to the present invention installed thereon.

Referring to the drawings and particularly FIG. 1, a can filler machine 11 of generally conventional construction is shown having a filler bowl 41. Extending from the bottom of the filler bowl 41 are a plurality of can centering bells 355 which form the bottom portion of filler valve assemblies 31. The filler valve assemblies 31 are built into the filler bowl 41.

As is well-known, the filler machine 11 in normal operation rotates and beverage cans to be filled are fed onto the rotating conveyor 21; each can in succession is raised into its respective bell 355 by a lifter 22 and the can is filled by the operation of filler valve assemblies 31 and valve levers 42 in a well-known manner.

In operation of the filler machine with the sanitizer system of the present invention there are, of course, no cans fed to the rotating conveyor 21. Instead a plurality of manifold elements 131 are arranged to engage the bells 355 of the filler valve assemblies 31. Each manifold 131 has a plurality of cylindrical projections 133. In the embodiment illustrated in FIG. 1 there are five cylinders 133 for each manifold 131. The total number of valves in the machine 11 is 100 so that 20 manifolds 131 accommodate all valves of the machine. A greater or lesser number of cylinders 133 may be provided on manifolds 131 but preferably not less than three or more than eight. In some cases it may be necessary to use different manifolds with different numbers of cylinders to accommodate all valves of a filler machine. For example, for 72 valves one might use 14 5-cylinder manifolds plus one 2-tube manifold. The can filler machine disclosed herein is of a conventional type such as that produced under the name Crown Uniblend.

Figure 5:
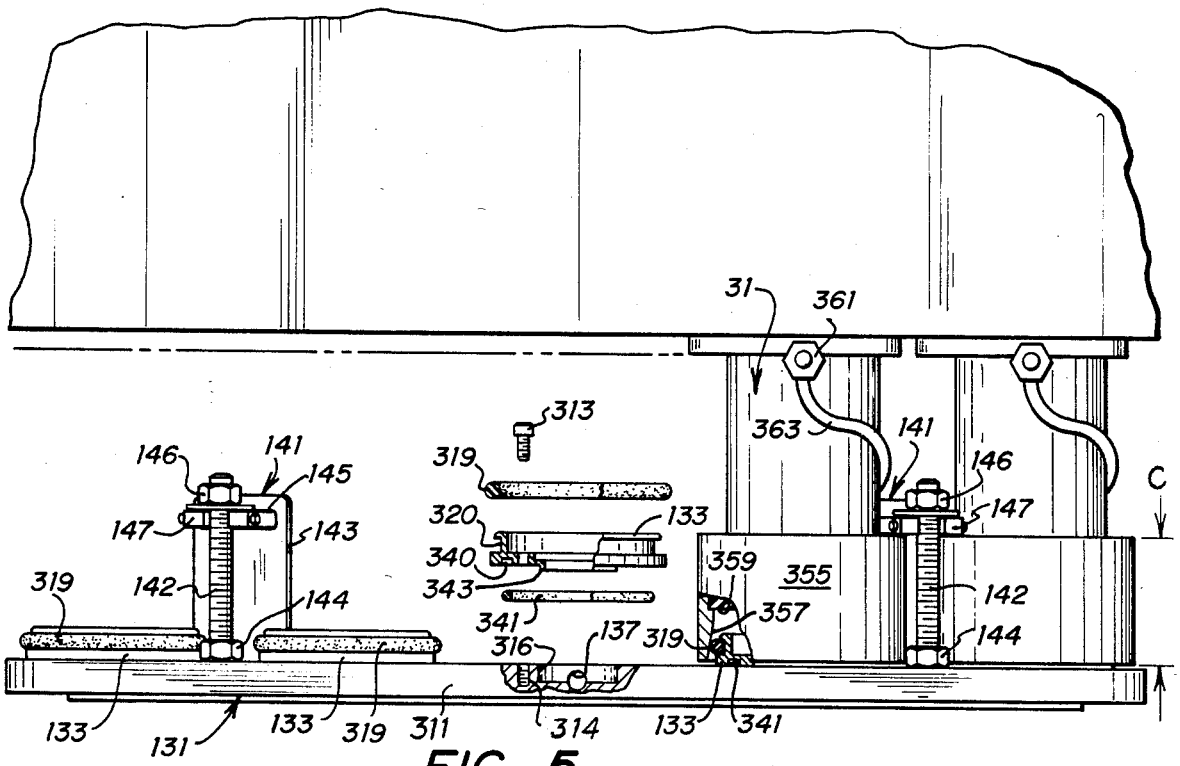
FIG. 5 is a side elevational, partially exploded, fragmentary, view of a manifold according to the present invention.

Manifolds 131 are raised upward to firmly contact bells 355 by clamps 141 which are shown in more detail in FIG. 5.

A raised platform 153 is secured on the filler machine to rotate with bowl 41. It includes legs 155 and annular plate 157. A rotating collector 161 is secured to plate 157 by machine bolts or other conventional means so that the flange 163 and external housing of the rotating collector rotates with platform 153 and the filler bowl 41. The rotating collector has a core pipe 165 which remains stationary and an elbow connector element 167, also stationary, connects to the core pipe 165. Liquid return tube 171 receives the sanitizing liquid and returns it to the system for re-circulation and reheating. Pipes, tubing, fittings, and other components which are in contact with the product are formed of stainless steel, Teflon, or other material accepted for food products handling applications.

A flexible tubing 151 connects from each of the manifolds 131 to the rotating collector 161. Tubing 151 may be flextube of stainless steel lined with Teflon. Preferably the flexible tubing 151 is permanently threaded at the top end into the rotating collector and has a quick connect fitting 158 at the lower end for connection to a manifold 131. This permits the manifold 131 to be removed quickly and easily while the flexible tubing 151 remains on the machine. A dummy connector 159 is provided to secure the end of flexible tubing 151 during normal operation of the machine so that it will not swing free and interfere with the normal filling operation. The tubing 151 is sealed at the lower end by dummy coupling 159 when not in actual use so that any contamination of the system is effectively prevented.

Figure 2:
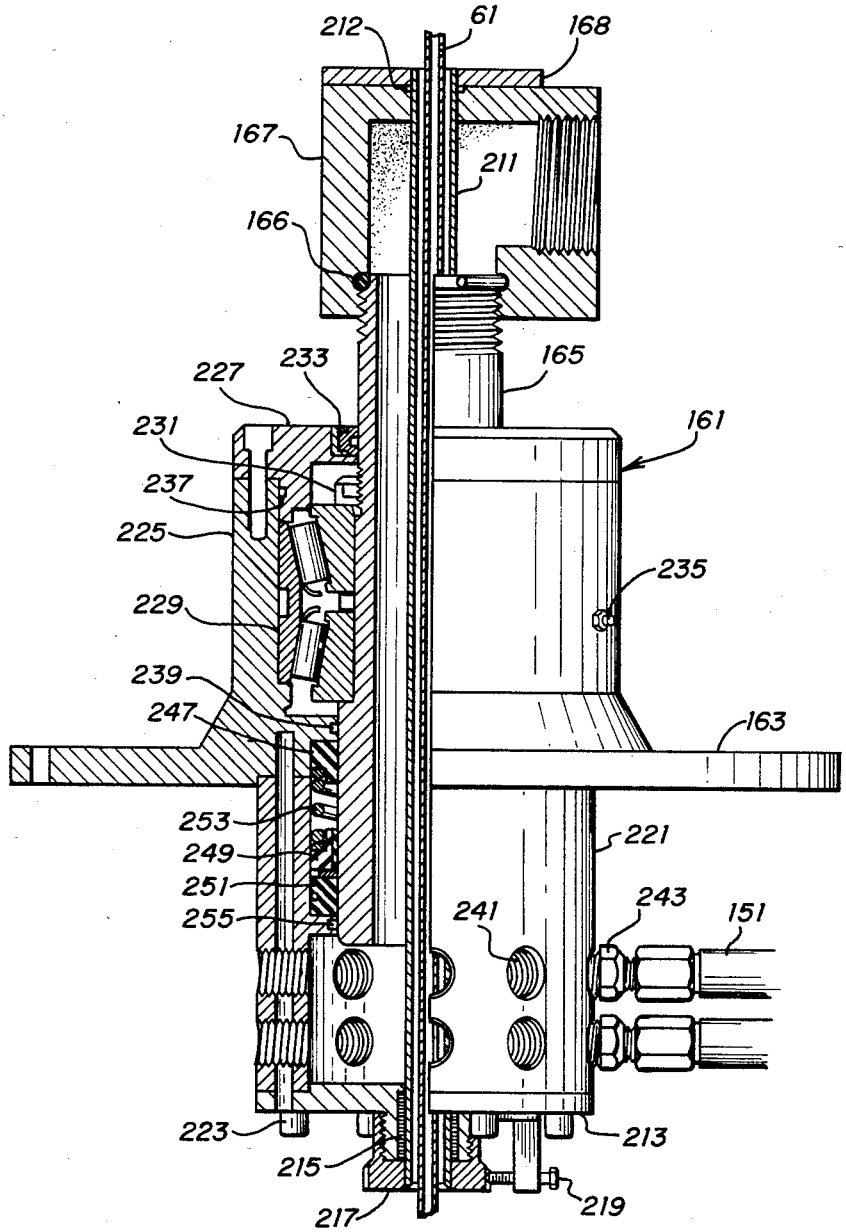
FIG. 2 is an enlarged, partially sectional, detailed view of the rotating collector device of the present invention.
Figure 3:
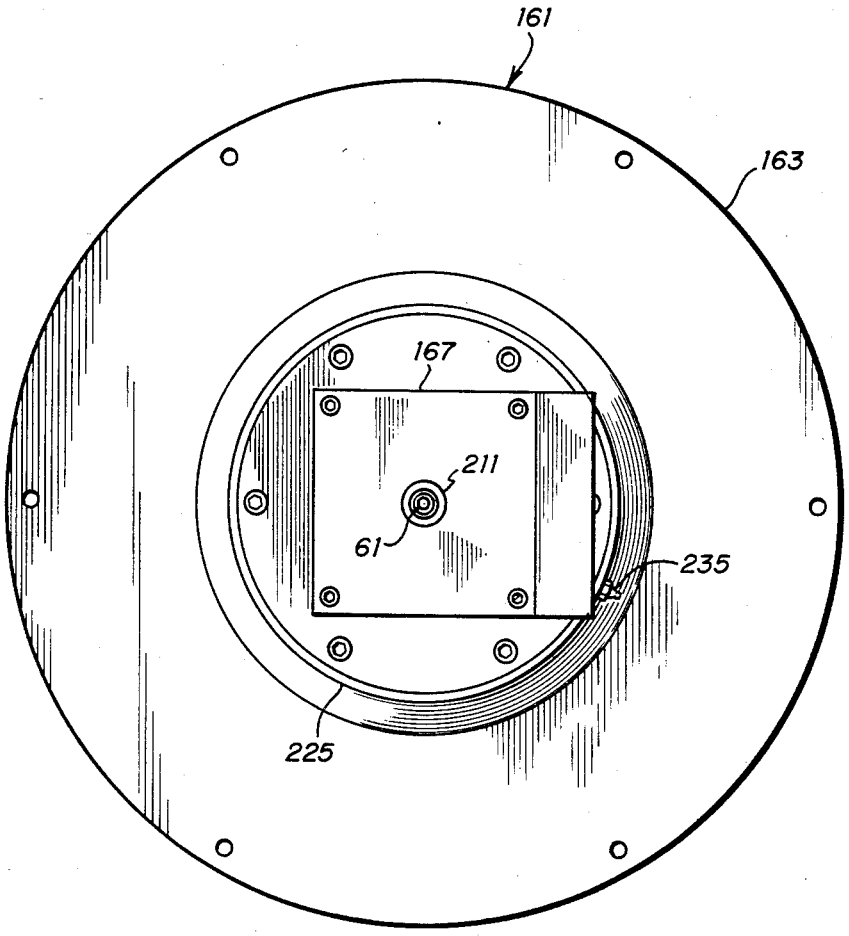
FIG. 3 is a top plan partially fragmentary view of the apparatus of FIG. 2.

Can filler machines of the type involved hereare customarily supplied with carbon dioxide ($CO_2$) under pressure to maintain carbonation in the beverage product and for other purposes. The filler machine 11 is provided with a $CO_2$ line 61 which is stationary and passes freely through a central opening in rotating collector 161 inside core pipe 165. The $CO_2$ line 61 passes into a rotating coupling 63 and the $CO_2$ line is connected into the filler bowl by means not relevant to the present invention and not shown in FIG. 1. Rotating collector 161 is shown in more detail in FIG. 2.

The rotating collector 161 is mounted on the can filler machine concentrically with the axis of rotation of the machine. The $CO_2$ line 61 of the filler machine passes through the center of the rotating collector.

If the $CO_2$ line of the filler machine is of a diameter greater than $\frac{3}{8}$ths inches, it is preferably replaced with a $\frac{3}{8}$ths inch outside diameter line, at least for that portion which passes through the rotating collector 161. The $CO_2$ line is stationary.

Due to the fact that the rotating joint 63 on the filler machine which retains the bottom end of $CO_2$ lines 61 is sometimes slightly off-center, the opening through the rotating collector to accommodate the $CO_2$ line 61 is larger than the outside diameter ($\frac{3}{8}$ths inch) of the $CO_2$ line. It may have an inside diameter of $\frac{3}{4}$ths inch. This permits truly concentric mounting of rotating collector 161 even though rotating joint 63 is slightly off-center.

Interior tube 211 extends the length of the rotating collector 161 and provides the through-opening for $CO_2$ line 61. Interior tube 211 is stationary and a seal at the bottom thereof is provided by a rotating joint 213 including packing 215 and packing nut 217. Packing nut 217 is tightened to form a rotating liquid-tight seal around interior tube 211 and is locked by a locking screw 219. Rotating joint 213 is, of course, a rotating member and is secured to the bottom of the chamber 221 of rotating collector 161 by machine bolts 223 or other suitable means.

The bearing unit 225 or rotating collector 161 includes a flange 163 by which the rotating collector 161 is attached to annular plate 157 over the center of the rotatable filler bowl of the can filler machine 11. Bearing element 225 includes a cap 227 which may be secured in place by recessed machine bolts (not shown in FIG. 2). A double roller combination bearing 229, is mounted in bearing unit 225 and is held in place therein by cap 227. Chamber 221, bearing unit 225 and cap 227 rotate together as a unit with the rotating portions of the filler machine 11.

The internal races of bearing 229 slide onto core element 165 and bearing 229 is secured in place on core element 165 by collar 231 which threadedly engages core element 165. It will be noted that the rotating collector 161 is positioned longitudinally as well as radially on core element 165 by bearing 229 so that the only movement of bearing unit 225 relative to core element 165 is rotational. The top of bearing element 229 is provided with a conventional grease seal 233 and a grease fitting 235 is provided to facilitate lubrication of bearing 229. An O-ring 237 provides a tight seal between cap 227 and the side of bearing unit 225. An O-ring 239 provides a grease seal art the rotating joint between the bottom portion of bearing unit 225 and the core element 165.

Chamber element 221 is provided with a number of ports 241 for the connection of flexible tubing 151 through threaded fittings 243 or other suitable means.

The interior of chamber 221 communicates with the open bottom end of core element 165 and a rotating seal is provided between chamber 221 and core element 165 by a conventional packing element configuration including packing and sealing elements 247, 249 and 251 to which a loading force is applied by a spring 253. An additional O-ring seal 255 is provided below sealing packing element 251. The liquid tight rotating seal arrangement including elements 247, 249, 251, 253, and 255 is conventional and commercially available (for example 3.00 in. PK Seal by Garlock, Inc.), and may be replaced by other conventional liquid-tight rotating joint structures. As previously described the interior tube 211 is provided with a rotating seal as it passes through the bottom of chamber 221 by packing 215 and packing nut 217. Thus the top and bottom rotating joints for chamber 221 are provided with liquid tight seals and liquid entering through flexible tubing 151 is directed up through chamber 221, core element 165, elbow 167, and into pipe 171 for return to the fluid heating and handling system of the can filler installation. The connection between core element 165 and elbow 167 is sealed by O-ring 166. The top interior tube 211 is sealed by O-ring 212 secured in place by plate 168.

Figure 4:
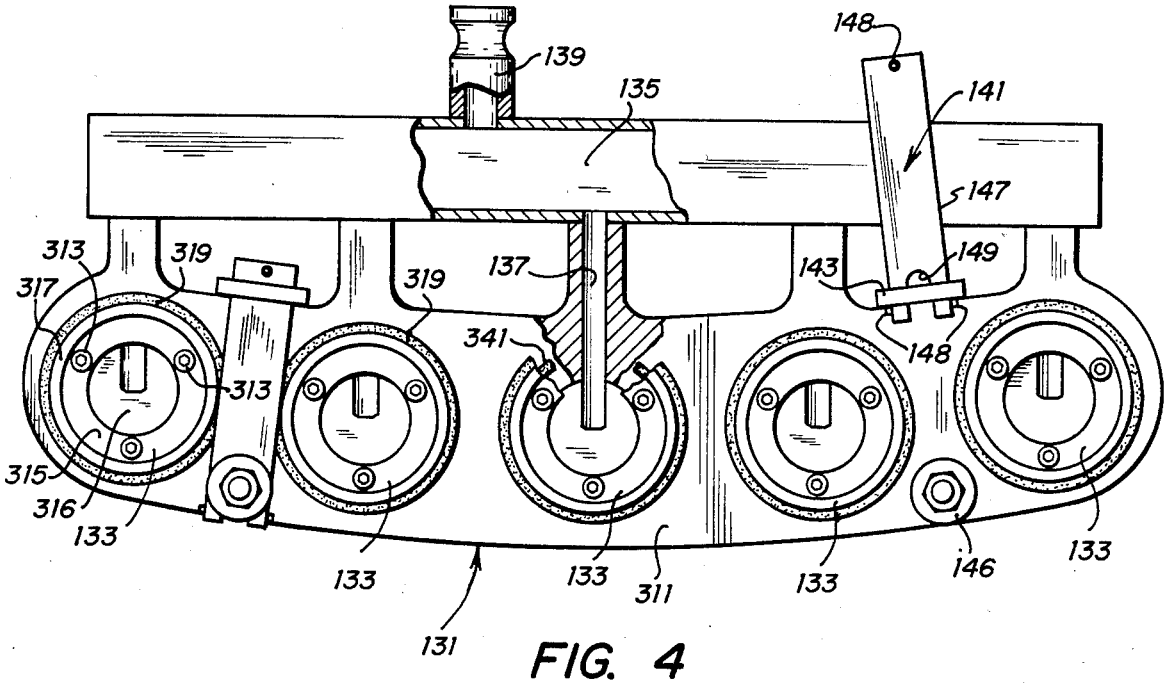
FIG. 4 is an enlarged top plan view of a manifold device according to the present invention.

FIGS. 4 and 5 show the construction of manifolds 131 in detail. Each manifold 131 includes a plurality, for example five, cylindrical projections 133 secured on base 311 by machine screws 313 threaded in tapped holes 314 or other suitable means. Each cylindrical projection 133 has a flange to accept screws 313 but the center is open through to base 311 which has channels extending from a recess 316 in the center of each projection 133 to a chamber 135. One quick connect fitting 139 is welded, brazed or otherwise secured to chamber 135 of manifold 131 and mates with a connector 157 on the end of flexible tubing 151.

The number of projections on each manifold may be varied, but five is a convenient number and the practical range is about three to eight. Of course, a short manifold is required to match the number of projections to the number of filler valves when the number of valves is not an exact multiple of the selected multiplicity of projections on each manifold. For example a 72-valve machine may use a 2-valve manifold to "come out even" with 5-valve manifolds. The manifolds 131 are preferably quite rigid and hence the base 311 is solid stainless steel except for channels 137 drilled into recesses 316.

As seen in FIG. 5, O-rings 319 reside in side slots in cylinder walls 317; they are a snug fit in centering bells 355 which have an inside taper 357 at the lower edge. A good seal is thereby provided at the bottom of bells 355 causing all but the lowest fraction of an inch of the interior of the bell 355 to be exposed to the circulating sanitizing solution. This sealing arrangement is very advantageous compared to one utilizing the normally operative sealing rubber 359 which is used to seal against the top lip of the beverage can in the actual filling operation. Bottle filler machine sanitizers have very successfully used the normal bottle seal rubber as a seal for a sanitizer, see U.S. Pat. No. 4,414,036. A corresponding arrangement using rubber 359 is not as successful and is far inferior to the apparatus of the present invention.

Note that the entire sealing rubber 359 as well as the interior of the bell 355 in proximity thereto is exposed to the sanitizing fluid as it circulates through the apparatus. Also the manifold 131 does not apply any pressure to the sealing rubber 359 while it is exposed to the hot sanitizing solution. Simultaneous heat and pressure have been found to cause deformity of sealing rubbers 359 to the point of rendering them unfit for use in the filling operation. Even though manifolds 131 seal against the lower part of bells 355 the vertical space they occupy is minimal, and they are spaced well above the can conveyer. Accordingly, they create no interference with can lifters, can guides or the like; and the sanitizing operation requires no disassembly of major filler machine elements to provide clearance for the apparatus of the invention.

Installation of the manifolds is accomplished quickly and easily by use of clamps 141 (two for each manifold). Each clamp 141 includes a threaded stud 142 and an upright 143. Stud 142 is locked in place with lock nut 144, and strap 147 bridges from upright 143 to stud 142 with its edges engaging the top rims of bells 355 between a pair of filler valves 31. Bells 355 have a dimension C of about two inches. Strap 147 is held in place by nut 146 on stud 142 while it is captured on the other end in opening 145 in upright 143. Slot 149 accommodates stud 142 and pins 148 prevent strap 147 from being separated from the manifold 131. Straps 147 are placed so they do not interfere with snift tubes 363.

Figure 6:
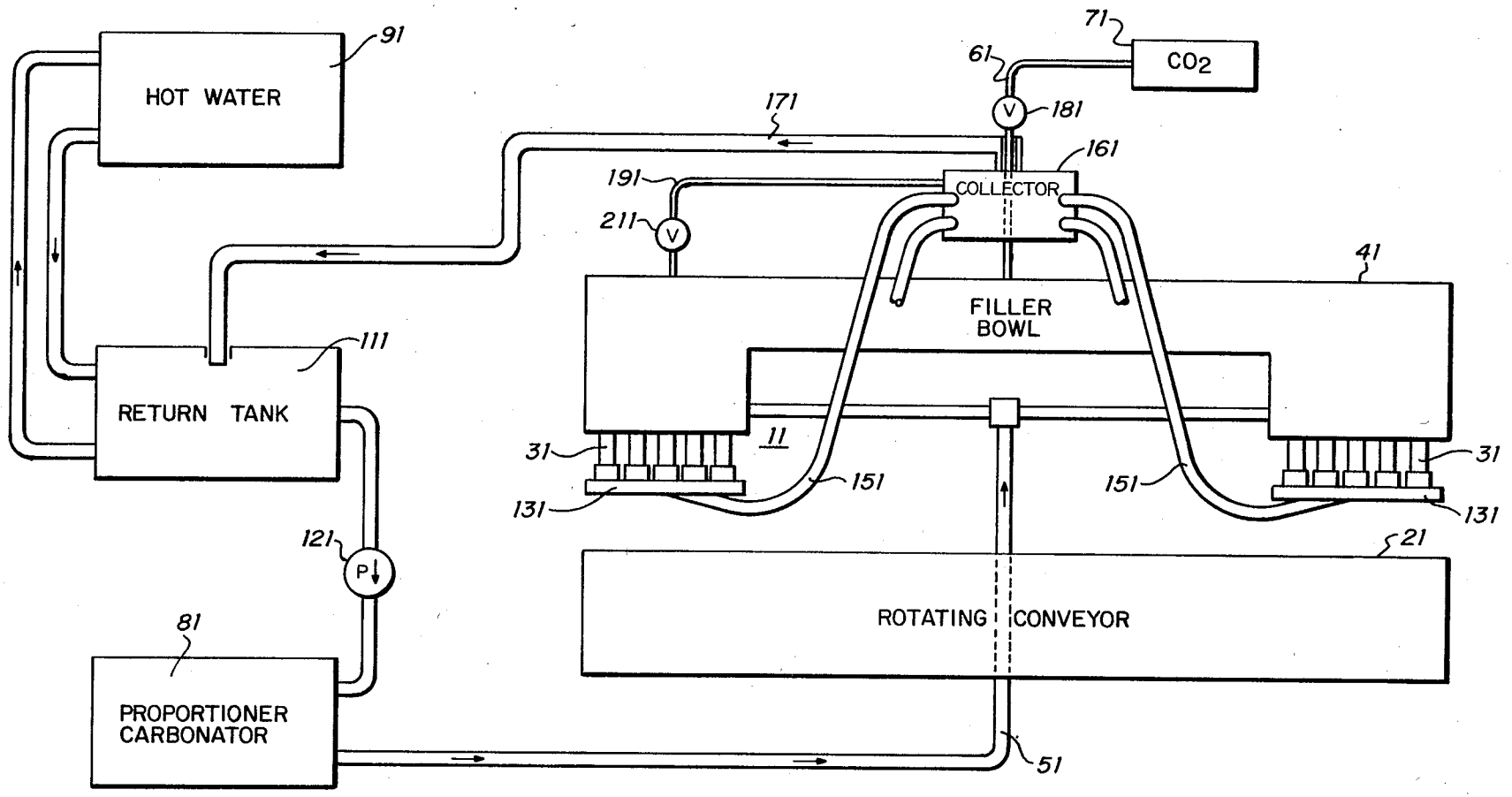
FIG. 6 is a schematic diagram of apparatus according to the invention, together with cooperating portions of conventional can filler machine apparatus.

The overall operation of the system may be best understood by reference to FIG. 6. The can filler machine installation will normally be provided with sanitizing equipment including a hot water source 91, a return tank 111 connected to the hot water source 91 and provided with suitable controls for maintaining water temperature. A pump 121 transfers fluid under pressure to the proportioner carbonator 81 through which it flows to the filler bowl 41 of the filler machine 11. Also included but not shown in FIG. 6 are valves, conduits, and containers, whereby detergent, sanitizing fluid, water, and mixtures thereof may be introduced to the proportioner carbonator and to the filler bowl of the machine. In the event that such apparatus is not included in the existing installation, it would need to be added for optimum operation of the system according to the present invention.

The details of the sanitizing sequence would vary depending on the requirements of the particular system and the product characteristics but an example of the sequence might be (1) prerinse with cool treated water; (2) wash with detergent with one-half percent sodium hydroxide solution at 140° F. with ten minutes of re-circulation; (3) rinse with hot water at 140° F. five to ten minutes; (4) hot sanitize with water at 185° F. with fifteen minutes of recirculation; (5) rinse with treated water to 140° F. for gradual cool-down.

As previously discussed the sanitizer system of the invention obtains various advantages by operating with the filler bowl and valves in motion. The conversion from the normal filling operation to the sanitizing operation is quite simple. There is, of course, no input of cans to the filler in the sanitizing operation. Instead the clamps 141 are utilized to secure manifolds 131 in place so that each filler valve is in sealing contact with and feeds into a respective cylinder 133 of a manifold 131. The clamps 141 and manifolds 131 are designed to properly engage the filler valves without interference with can conveyor apparatus. Usually the liquid level in the filler bowl is controlled by a counter-pressure of $CO_2$ indicated by gauge 210 which in turn is adjusted by a float valve in the filler bowl. In the sanitizing operation it is desired that the filler bowl be completely flooded to insure that all parts of the apparatus are sanitized. Accordingly an overflow tube 191 similar to flexible tube 151 is connected to an extra port 241 on rotating collector 161. Valve 211 opens to connect the overflow port on the filler bowl through tube 191 to collector 161. At the same time the carbon dioxide source 71 is shut off by valve 181 with the result that filler bowl 41 fills with liquid and overflows through tube 191.

The rotating conveyor 21 is rotated, preferably at approximately one-half normal speed for product filling, and the valve opener is set in "open" position so that the valve operating cams turn the valves to open. The valve closing roller is disengaged so that all valves stay open during the sanitizing operation.

The particular fluid being used at a particular stage of the sanitizing operation fills the filler bowl to overflowing and flows through the filler valves into the manifolds 131 where the fluid is forced up through tubes 151 to collector 161. Sufficient fluid is provided so that the entire apparatus is flooded to above the level of collector 161. From collector 161 the fluid returns through stationary return pipe 171 to the return tank 111.

The can filler machine snift valves in the normal filling operation open momentarily to relieve pressure and foaming and facilitate a uniform fill of the beverage cans. In the sanitizing operation the snift valves 361 are preferably allowed to operate in their normal manner so that each snift valve 361 is opened as it passes the snift cam and heated solution passes through the snift valve. In this manner each and every component of the can filler apparatus is exposed to the sanitizing solution at elevated temperature and complete sanitization is assured.

At the end of the procedure cool water will be in the filler bowl and it may be drained to the floor drain in a conventional manner through a product line drain valve.

Flexible tubes 151 are disconnected from manifolds 131 and the ends thereof are secured in place on dummy couplings 159. The clamps 141 are loosened and manifolds 131 are removed from the can filler machine. The desired adjustements are then made to the machine to ready it for a normal product filling operation.

While a preferred embodiment of the invention has been illustrated and described, it should be noted that numerous variations and modifications might be made to the apparatus. For example, the number of filler valve-accommodating tubes on each manifold may be different and the shape of the manifold may vary from the arcuate shape illustrated. The clamps 141 may be replaced by a different mechanism to hold the manifolds in position. The quick disconnect fittings 157 are very convenient but they are not essential to the operation of the device. The particular manner in which fluid connections are made from the rotating filler valve assembly to the stationary return line may be modified

What is claimed is:

1. A sanitizer system for a beverage can filler machine having a rotating bowl and associated circular array of filler valves with internally tapered cylindrical centering bells, a reservoir and a rotating conveyor comprising a plurality of collector manifolds, each having a chamber with an outlet opening and at least three upward cylindrical projections with peripheral sealing means adapted to seal against the internal taper of the centering bells of filler machine valves, said projections' interiors communicating with said chamber and being in an arcuate arrangement with a radius corresponding to that of a filler machine valve array, means for holding each said manifold in a raised position off said rotating conveyor to cause all of its projections to seat and seal against corresponding centering bells of said can filler machine and to receive liquid flow from said valves when open, a plurality of flexible hoses, each connectable at one end to one of the outlet openings of said manifolds, a stationary return pipe connected to said reservoir, a rotating collector located above said bowl and having a plurality of inlets with said hoses connected thereto and a rotatable, liquid-tight connection with said return pipe, whereby a liquid return path is provided from said manifolds through said rotatable liquid-tight connection to said stationary return pipe to a reservoir.

2. Apparatus as recited in claim 1 wherein said collector is arranged with the rotatable connection to said return pipe coaxial with the axis of rotation of said rotating conveyor.

3. Apparatus as recited in claim 1 wherein said filler machine includes a filler bowl and said sanitizer system further includes a hose with one end connected to receive overflow from said filler bowl and the end connected to said collector.

4. Apparatus as recited in claim 1 wherein said means for holding each said manifold in a raised position includes a plurality of clamps adapted to be secured on the exterior of said filler valves.

5. A sanitizer system for a beverage can filler machine having a rotating bowl and associated circular array of filler valves with internally tapered cylindrical centering bells, a reservoir and a rotating conveyor comprising at least eight collector manifolds, each having an outlet opening and at least three inlet channels communicating with respective open-top hollow cylinders with peripheral sealing means adapted to fit in and seal against the internal taper of the centering bells of filler machine valves, said cylinders being in an arcuate arrangement with a radius corresponding to that of a filler machine valve array, means for holding each said manifold in a raised position spaced above said rotating conveyor to cause all of its projections to seat and seal against corresponding centering bells of said can filler machine and to receive liquid flow from said valves when open, a plurality of flexible hoses, each connectable at one end to one of the outlet openings of said manifolds, a stationary return pipe connected to said reservoir, a rotating collector located above said bowl and having a plurality of inlets with said hoses connected thereto and a rotatable, liquid-tight connection with said return pipe, whereby a liquid return path is provided from said manifolds through said rotatable liquid-tight connection to said stationary return pipe and to a reservoir.

6. Apparatus as recited in claim 5 wherein said collector is arranged with the rotatable connection to said return pipe coaxial with the axis of rotation of said rotating conveyor.

7. Apparatus as recited in claim 5 wherein said filler machine includes a filler bowl and said sanitizer system further includes a hose with one end connected to receive overflow from said filler bowl and the end connected to said collector.

8. Apparatus as recited in claim 5 wherein said means for holding each said manifold in a raised position includes a plurality of clamps adapted to be secured on the exterior of said filler valves.

9. Apparatus as recited in claim 5 wherein said peripheral sealing means includes an O-ring.

10. A sanitizer system for a beverage can filler machine having a rotating bowl and associated circular array of filler valves with internally tapered cylindrical centering bells, and a reservoir comprising a plurality of collector manifolds each with an outlet opening and at least three hollow projections with sealing means adapted to seal against the centering bells of filler machine valves, said projections communicating with said outlet opening and being in an arcuate arrangement with a radius corresponding to that of a filler machine valve array, means for holding each said manifold in a position to cause all of its projections to seal against corresponding centering bells of said can filler machine and to receive liquid flow from said valves when open, a plurality of flexible hoses, each connectable at one end to one of the outlet openings of said manifolds, a stationary return pipe connected to said reservoir, a rotating collector located above said bowl and having a plurality of inlets with said hoses connected thereto and a rotatable, liquid-tight connection with said return pipe, whereby a liquid return path is provided from said manifolds through said rotatable liquid-tight connection to said stationary return pipe and to a reservoir.

11. Apparatus as recited in claim 10 wherein said collector is arranged with the rotatable connection to said return pipe coaxial with the axis of rotation of said bowl.

12. Apparatus as recited in claim 10 wherein said filler machine includes a filler bowl and said sanitizer system further includes a hose with one end connected to receive overflow from said filler bowl and the end connected to said collector.

13. Apparatus as recited in claim 10 wherein said means for holding each said manifold in position includes a plurality of clamps adapted to be secured on the exterior of said filler valves.

* * * * *